US010792206B2

(12) United States Patent
Soytürk et al.

(10) Patent No.: US 10,792,206 B2
(45) Date of Patent: Oct. 6, 2020

(54) MEDICAL OR ORGANIZATION CART

(71) Applicant: FIRMA, Weilheim (DE)

(72) Inventors: Erkan Soytürk, Weilheim (DE); Rainer Üblacker, Weilheim (DE)

(73) Assignee: FIRMA, Weilheim (DE)

( * ) Notice: Subject to any disclaimer, the term of this patent is extended or adjusted under 35 U.S.C. 154(b) by 0 days.

(21) Appl. No.: 16/386,481

(22) Filed: Apr. 17, 2019

(65) Prior Publication Data

US 2019/0321248 A1 Oct. 24, 2019

(30) Foreign Application Priority Data

Apr. 18, 2018 (DE) ..... 20 2018 102 153 U

(51) Int. Cl.

| | |
|---|---|
| ***A61G 12/00*** | (2006.01) |
| ***B25H 1/08*** | (2006.01) |
| ***B25H 1/10*** | (2006.01) |
| *A47B 31/00* | (2006.01) |

(52) U.S. Cl.

CPC ..... *A61G 12/001* (2013.01); *A47B 2031/006* (2013.01); *B25H 1/08* (2013.01); *B25H 1/10* (2013.01)

(58) Field of Classification Search

CPC ..... B25H 1/08; B25H 1/10; A61G 12/001; A47B 2031/006

USPC ..... 224/401, 567; 108/147.13; 248/230.7; D34/27

See application file for complete search history.

(56) References Cited

U.S. PATENT DOCUMENTS

| | | | | | |
|---|---|---|---|---|---|
| D188,238 | S | * | 6/1960 | Blum | D8/373 |
| 4,595,107 | A | * | 6/1986 | Welsch | A47B 57/265 108/147.13 |
| 4,821,988 | A | * | 4/1989 | Jimenez | A61G 5/10 248/227.3 |
| 4,871,141 | A | * | 10/1989 | Chen | A45B 11/00 248/534 |
| 5,058,911 | A | * | 10/1991 | Hunter | B25H 1/12 212/196 |
| 5,079,802 | A | * | 1/1992 | Blase | A47L 9/248 24/16 PB |
| 5,642,557 | A | * | 7/1997 | Clews | E04B 2/7442 24/339 |
| 5,647,420 | A | * | 7/1997 | Michell | B23D 59/007 144/253.1 |

(Continued)

FOREIGN PATENT DOCUMENTS

| | | |
|---|---|---|
| DE | 20018317 U1 | 2/2001 |
| WO | 2016/015102 A1 | 2/2016 |

*Primary Examiner* — Justin M Larson

(74) *Attorney, Agent, or Firm* — Nixon & Vanderhye

(57) ABSTRACT

Disclosed is a medical or organization cart with a cart body which is in particular essentially formed in the shape of a straight prism, and at least one corner post which may at least be indirectly fixed vertically to the cart body. At the corner post, at least one cross strap and/or one adapter, in particular made out of plastic, for attaching accessories at the medical or organization cart may be mounted. The adapter may be mounted both at the corner post and at the cross strap and/or the cross strap at the corner post, without using tools, in particular by clamping, and may be detached from the latter. The cross strap and/or the adapter may, when mounted at the corner post, be swiveled horizontally around the corner post.

20 Claims, 6 Drawing Sheets

(56) References Cited

U.S. PATENT DOCUMENTS 5,960,968 A * 10/1999 Wang ..... A47B 57/545 108/147.13
5,971,512 A * 10/1999 Swan ..... B25H 1/10 211/131.1
D426,043 S * 5/2000 Lu ..... D34/20
6,079,575 A * 6/2000 Wang ..... A47B 55/02 108/110
6,086,073 A * 7/2000 Tisbo ..... B25H 1/02 280/47.26
D444,603 S * 7/2001 Murphy ..... D32/31
D537,331 S * 2/2007 Hill ..... D8/395
D660,690 S * 5/2012 Mixides ..... D8/396
8,235,402 B2 * 8/2012 Knappe ..... A61G 12/001 280/47.26
8,333,160 B2 * 12/2012 Lin ..... B25H 3/02 108/147.13
8,522,394 B2 * 9/2013 Lee ..... A47L 9/0036 15/323
8,678,136 B1 * 3/2014 Hamilton ..... E04G 5/003 182/129
8,839,724 B2 * 9/2014 Allen ..... A61B 50/10 108/92
9,527,205 B1 * 12/2016 Lin ..... B25H 1/12
D776,391 S * 1/2017 Daniell ..... D34/21
9,538,864 B2 * 1/2017 Williams ..... A61B 50/22
D783,890 S * 4/2017 Samson ..... D26/138
10,144,123 B1 * 12/2018 Shaw ..... B25H 5/00
10,335,244 B2 * 7/2019 Norman ..... E05B 65/467
D884,261 S * 5/2020 Long ..... D26/138
2006/0101955 A1 * 5/2006 Chang ..... B25G 1/085 81/490
2006/0237933 A1 * 10/2006 Suchecki ..... B62B 3/002 280/79.2
2010/0007250 A1 * 1/2010 Sharpe ..... A61G 12/001 312/209
2011/0068562 A1 3/2011 Keffeler et al.
2012/0061529 A1 * 3/2012 Hill ..... H01R 4/48 248/65
2017/0215579 A1 * 8/2017 Cooper ..... A47B 47/0083
2019/0321248 A1 * 10/2019 Soyturk ..... A61G 12/00
2019/0344816 A1 * 11/2019 Soyturk ..... B62B 3/002

* cited by examiner

MEDICAL OR ORGANIZATION CART

BACKGROUND OF THE INVENTION

Field of the Invention

The invention concerns a medical or organization cart.

Description of the Related Art

Medical or organization carts are widely used in hospitals in order to transport, for example, medical products and/or serve the purpose of supporting internal processes in a ward for mobile stock-keeping for further objects such as, for instance, medical apparatuses and/or disinfectants.

It has already been suggested to store such objects or medical products not only inside a medical or organization cart, but, if, for example, these are needed more frequently, also at the sides or back of the medical or organization cart, if necessary, so that these may be made available more easily and practically. As a result, the other objects positioned inside the cart may remain there free of vibrations, i.e. without being tipped over or knocked over by accident, for instance.

In order to hang these objects, which may also be regarded as accessories, at the sides or back of a medical or organization cart, an additional component is required.

Medical or organization carts are known which are provided each with a rail system for attaching accessories. The rail system is usually provided with a multitude of posts and straps which are arranged in a fashion perpendicular to each other. The posts are tightly connected with the cart by means of additional connection elements, and the straps with the accessories are vertically displaceable at the post.

However, such a rail system is rather complex, and the assembly and disassembly of the posts at the cart as well as the adjustment of the straps at the posts is time consuming.

If, for example, some components are accidentally not properly connected with the cart or the posts, respectively, during assembly, there is the danger that the rail system may get disconnected from the cart during transport of the cart and the accessories may fall down from it.

The multitude of necessary components for the rail system at the cart additionally put at risk the balance of the cart and may lead to a tipping over of the cart, in particular if the cart is pushed quickly around a corner.

Other medical or organization carts are known which are formed in a less complex fashion, but are not structurally stable and therefore are not suitable for a secure attachment of accessories at the cart.

SUMMARY OF THE INVENTION

In contrast to that, the disclosed device is a medical or organization cart for which the accessories may be attached in a stable and variable fashion.

Surprisingly, a reliable attachment of accessories at a cart is possible with the medical or organization cart in accordance with the invention, despite a relatively simple structure, thanks to a clamping force.

The medical or organization cart in accordance with the invention is provided with at least one corner post. At the corner post, at least one strap element with a connection element and/or an adapter may be mounted for attaching accessories. With the help of at least one guide element at the corner post, mountings may be put into practice for preferred locations at which the strap element may be pushed on.

In order to guarantee a secure mounting of an adapter or a connection element, respectively, at a corner post, several possibilities are available. Besides mounting by means of a clamping force, mounting is possible, for instance, by means of magnetic coupling. For this purpose, an adapter or a connection element, respectively, in which magnets are embedded, is used with, for example, a ferromagnetic corner post.

Furthermore, a tongue-groove combination offers improved mounting at discrete locations of the corner post. Herein, it is possible to provide a guide groove at the corner post, and a tongue at the adapter or the connection element, respectively, and vice versa. Furthermore, the groove or tongue, respectively, at the corner post is referred to as the guide element, the tongue or groove, respectively, at the adapter and/or the connection element as the coupling element.

In accordance with the invention, the guide element is located at the peripheral, i.e. the radial outer margin of the corner post.

The connection element of the strap element and/or the adapter partly encompasses the corner post. Since the inside diameter of the connection element of the strap element or the adapter, respectively, is slightly smaller than the outside diameter of the corner post, the connection element of the strap element and/or the adapter, respectively, exerts a preload at the outside of the corner post during the encompassment. As a result, a reliable clamping of the strap element and/or of the adapter at the corner post has been put into practice.

In accordance with the invention, the adapter may be mounted both at the corner post and at the strap element, and/or the strap element at the corner post, without using any tools, in particular by means of clamping, and is detachable from it without using any tools. Compared with a known medical or organization cart with a rail system attached laterally, for instance with the help of screw connections, such components are economized in accordance with the invention. Insofar, in accordance with the invention, a faulty or disorderly assembly is avoided as far as possible, and the attachment/detachment of the accessories is accelerated.

In accordance with the invention, it is favorable that the strap element and/or the adapter, if the latter is mounted at the corner post, may be swiveled horizontally around the corner post. Herein, the connection element and/or the adapter is provided with at least three at least dot-shaped contacts with the corner post, i.e. its guide element. These, however, may also be shaped to be considerably larger than dot-shaped, for instance planar, and the contact surfaces such formed may merge into one another, too.

These contacts are situated in the same horizontal plane at the circumference of the corner post.

For instance, a tongue of the adapter or of the connection element as the coupling element may be guided inside a groove of the guide element in such a fashion that it may be freely rotated.

This solution leads to a swivelable, but clamping mounting of the strap element at the corner post.

When the cart is transported, the strap element may be swiveled horizontally towards the center of the cart or inside, respectively, by means of swiveling around the guide element, in order to avoid a protrusion of the cart and not to put at risk the balance of the cart.

If some work is done on the worktop of the cart, the strap element or the adapter at the corner post may be swiveled horizontally outside, in accordance with the invention, in order to clear the space above the cart.

In accordance with the invention, the adapter and/or the strap element may be mounted, in the longitudinal direction of the corner post, at any location of the corner post, and the adapter may be mounted, in the longitudinal direction of the strap element, at any location of the strap element and be dislocated against clamping force. In combination with the swivelability of the strap element or the adapter, respectively, at the corner post, a clearly more flexible attachment of accessories, compared with the state of the art, is possible.

In a preferred embodiment, the corner post should be fixable at different relative heights at the cart body.

If a larger number of accessory parts needs to be attached to the cart, the corner post may be fixedly attached at the cart at a relatively large height in order to mount a number of strap elements or adapters, respectively, at the corner post.

Another aspect concerns the balance of the cart which is supported by the corner post at a relatively low height.

Alternatively, the corner post is telescopically fixable to the cart body in a further preferred embodiment. As a result, the relative height of the corner post to the cart may be adjusted.

In a further preferred embodiment, the medical or organization cart should be provided with at least one corner profile which is provided with a fastening channel that extends vertically. The corner post engages into the fastening channel of the corner profile and may be fixedly attached there as well as be detached from the corner profile.

The ratio of the length of the portion of the corner post which extends above the fastening channel of the corner profile to the length of the portion of the corner post which is positioned inside the fastening channel amounts to maximally 5:1, in particular maximally 3:1, such that a stable attachment of the corner post inside the corner profile is guaranteed.

With this embodiment, additional lateral/front/rear components for fixedly attaching the corner post to the cart are no longer needed. This surprisingly reduces the space required for a medical or organization cart with trailed accessories, and therefore leads to an improved employability of the carts.

In addition, the handling of medical or organization carts is surprisingly improved in accordance with the invention.

In a hospital, it is important that medical or organization carts may be strung together, if required. A known medical or organization cart is provided with a rail system for attaching accessories at the side of the cart body, and due to the rail system attached at the side, with the accessory parts mounted at that, it is hardly possible to carry out an immediate stringing-together of the carts.

In contrast to this, with the cart in accordance with the invention, the corner post is not inserted at the side of the cart, but rather inside the corner profile of the cart, and all the strap elements and adapters mounted at the corner post may be swiveled horizontally towards the centre of the carts concerned, or inside, respectively, for the purpose of stringing together the carts.

In a further preferred embodiment, the fastening channel of the corner profile should be a screw channel, and the corner post should be provided with threads at its end which engages into the fastening channel, in order to screw the corner post into the corner profile. As a result, a simple and secure fixing of the corner post at the cart is possible in accordance with the invention.

In a further preferred embodiment, the medical or organization cart should be provided with a worktop which is in particular made partly out of plastic and which is fixedly attached on the cart body in particular by means of clamping it on.

The worktop is provided with at least one corner hole which runs vertically through the worktop. The corner post engages into the fastening channel of the corner profile via the corner hole of the worktop. For this purpose, the top surface of the worktop needs not be any smaller than the top surface of the cart body which is adjacent to the corner profile.

If at some time, no employment of a corner post at the cart is desired, the corner hole of the worktop may be closed by means of a cap, in particular a plastic cap, after removing the corner post.

In a further preferred embodiment, the strap element should be provided, for the connection with the corner post, with a connection element at its end which is adjacent to the corner post, which is in particular made out of plastic and may be clamped to the corner post.

In a further preferred embodiment, a preload or preloads, respectively, against the corner post should be provided at the connection element of the strap element and/or at the adapter, and in particular a further preload against the strap element should be provided at the adapter.

The preload or preloads, respectively increases or increase, in accordance with the invention, distinctly the stability of the mounting of the strap element and/or adapter at the corner post and/or of the adapter at the strap element, in particular the stability of this mounting against shear forces.

In three further preferred embodiments, it should be possible to mount, in particular to slip on or affix at, respectively, preferably to snap in the adapter at the corner post, in particular also at the strap element, and the strap element at the corner post by means of clicking into place, clamping or snapping in.

As a result, a user-friendly and reliable attachment of a strap element or an adapter, respectively, at the corner post, in particular of an adapter at a strap element, and a user-friendly detachment of the respective former from the latter is possible.

In a further preferred embodiment, the corner post should be provided with at least one groove at its radial outer side, which extends in particular in a horizontally circumferential fashion. The connection element of the strap element and/or the adapter is provided with a projection which, at least in part, in particular as at least a dot-shaped projection element, corresponds to the cross section of the groove, and which forms a positive connection of the strap element and/or the adapter with the corner post.

As a result, a click-in connection is possible. For the restriction of the swivelability of the strap element or the adapter, respectively, around the corner post to one particular swiveling angle, the groove may horizontally extend only at one portion of the outer side of the cross section of the corner post.

In accordance with the invention, the strength of the mounting of the strap element or the adapter, respectively, at the corner post is considerably increased as a result of the click-in connection. If the groove of the corner post is an undercut, the strength not only in the vertical direction, but also in the horizontal direction against possible shear forces during use of the cart is increased.

In accordance with the invention, the height-length ratio of the strap element amounts to at least 1:15, in particular at least 1:10, preferably at least 1:5, in order to guarantee a sufficiently large clamping surface at the corner post for the strap element. This adds to the sufficiently large clamping force.

Surprisingly, together with the sufficiently large clamping force, a good attenuation of the vertical vibrations of the horizontally extending strap body of the strap element with the accessory parts mounted thereat or thereon, respectively, is put into practice, in particular during transport of the cart.

In a further preferred embodiment, the strap element should be provided with a strap body extending in the longitudinal direction, which is in particular a hollow profile and preferably made out of a light metal. Thus, a sufficiently solid strap with low weight of the strap element may be put into practice, the load capacity of which has been optimized.

The strap body may be linked with the connection element, for example by means of clicking into place at an undercut or additional steel pins, and may be detached from it, if necessary. Thus strap elements of different lengths may be employed at the cart for different potential uses, if necessary.

In a further preferred embodiment, at the same time, at least two adapters should be mounted at the strap element or at the corner post, or, at least one adapter at the strap element and at least one further adapter at the corner post, which adapters commonly accommodate accessories. In particular, two adapters with a certain distance may be employed at a cross strap extending between two corner posts for accommodating a large accessory part.

Large accessories, such as a large bottle of disinfectant or broad accessories, respectively, are used in hospitals if needed. Several adapters at different locations for the common accommodation of such accessories improve the mounting of large or broad accessories, respectively, at a medical or organization cart.

In a further preferred embodiment, the adapter should be provided with at least one fastening element at which the accessories are mounted.

The fastening element is in particular provided with inside threads with the help of which a threaded accessory part may easily be attached to the adapter and be supported there.

The adapter is additionally provided with two retaining elements which are positioned in a fashion perpendicular to one another and are thus determined, on the one hand, for the vertical, on the other hand for the horizontal attachment.

With the help of these, the adapter may be mounted both at the strap element or cross strap, respectively, and at the corner post.

The retaining element of the adapter which may be used for vertical mounting, is U shaped, looked at from above. As a result, the adapter may be clipped to a vertical corner post. In contrast, the retaining element of the adapter for a horizontal attachment is situated at an approximately right angle to the vertical retaining element and is also provided with a U shape. Thus the desired medical or organization utensil may be fixedly attached both at a horizontal and at a vertical portion of the cart with the help of the adapter.

In a further preferred embodiment, the strap element should be provided with a further connection element which is linked with the end of the strap element which is remote from the corner post, and is connected to a further post which is in particular shorter than the corner post, wherein the further post ends above the cart body or the worktop, respectively. Insofar, the horizontal strap element may also be referred to as a cross strap.

As a result, the stability of the mounting of the strap element, together with the accessories accommodated thereat/thereon, at the cart is further improved. For the end of the strap element which is remote from the first corner post is mounted at the second post and is stiffened there.

Besides, the medical staff may easily grip the second post in this embodiment for swiveling the strap element or the cross strap, respectively, and then swivel the cross strap.

In a further preferred embodiment, at least two corner posts should be provided which extend in parallel to each other and are at least indirectly fixable at the cart body as well as between which and at which at least one strap element for the attachment of accessories at the medical or organization cart may be mounted.

As a result, the stability of the mounting of the strap element at the cart is distinctly increased since both ends of the strap element are mounted each at one corner post which is fixedly attached to the cart.

Moreover, in this embodiment a relatively long strap element, which extends horizontally along approximately the whole length of one side of the cart body, is provided for accommodating large accessories and/or a number of accessory parts.

BRIEF DESCRIPTION OF THE DRAWINGS

Further advantages, details and features result from the subsequent description of the exemplary embodiments of the invention with the help of the drawings which show.

DESCRIPTION OF THE PREFERRED EMBODIMENTS

Figure 1:
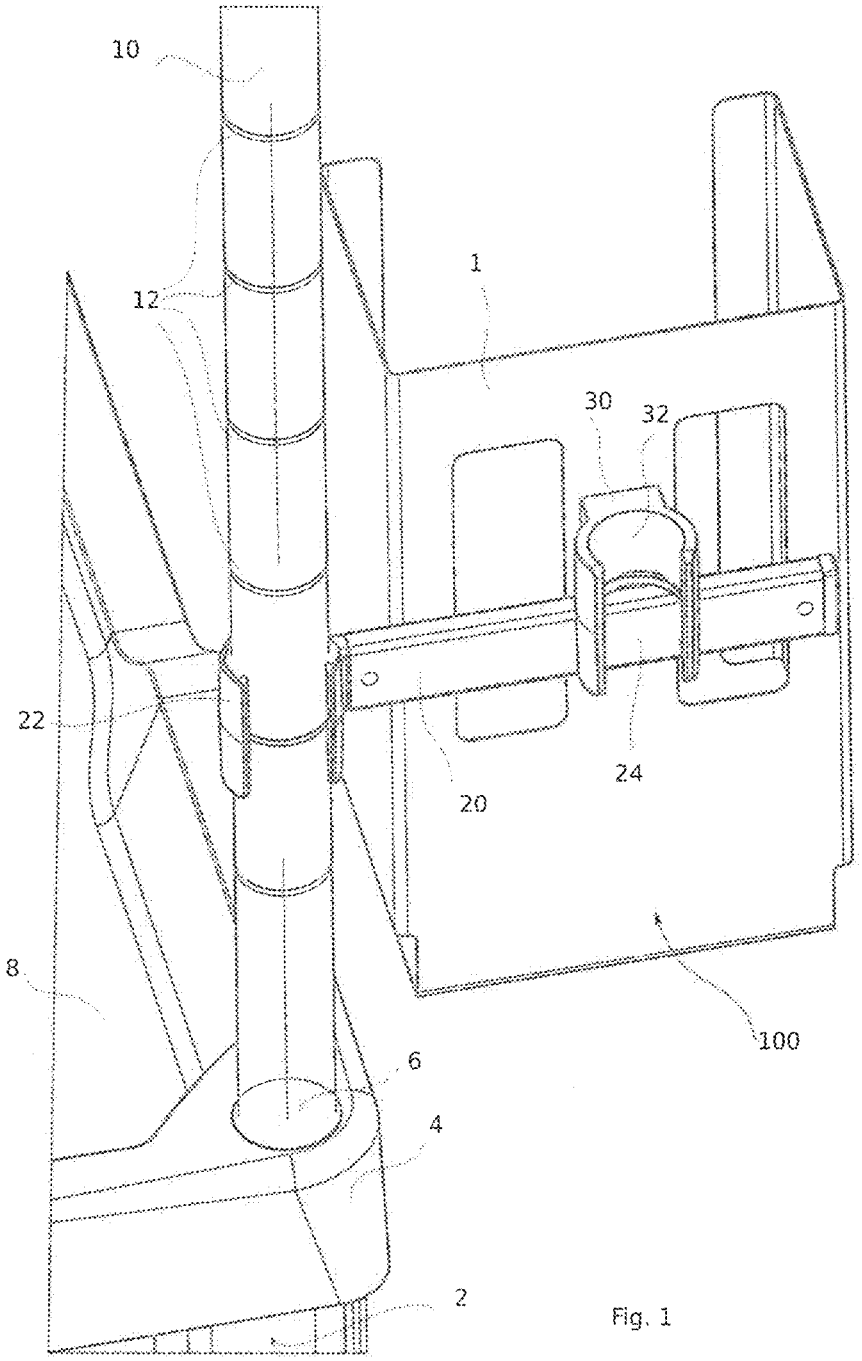
FIG. 1 a schematically depicted embodiment of the medical or organization cart in accordance with the invention.

The embodiment of the medical or organization cart 100 depicted in FIG. 1 is provided with a cart body 2, a corner profile 4 and a corner post 10. Cart body 2 is only schematically depicted in part in FIG. 1. Corner profile 4 is provided with a fastening channel 6 which extends vertically and engages with corner post 10 and is fixedly attached there.

This embodiment of medical or organization cart 100 in accordance with the invention is additionally provided with a strap element 20 and an adapter 30 for accommodating accessories. Strap element 20 is mounted at corner post 10 with the help of a connection element 22 made out of plastic. Connection element 22 of strap element 20 is detachably linked with a strap body 24 which extends in the longitudinal direction of strap element 20. At or on strap element 20, respectively, adapter 30 is mounted. Accessory part 1 is attached to adapter 30.

In accordance with the invention, adapter 30 may be mounted at strap element 20 and strap element 20 at corner post 10 without using any tools, by means of clamping, and is as well detachable from the latter without using any tools. As a result, a faulty assembly of strap element 20 and adapter 30 is avoided as far as possible, and at the same time the attachment of accessories at the cart is accelerated.

In accordance with the invention, it is favorable that strap element 20, in particular connection element 22 made out of plastic and clamping to corner post 10, may be horizontally swiveled around corner post 10.

During the transport of cart 100, it is of importance to keep the balance as far as possible. For this purpose, strap element 20 may be swiveled horizontally inwards. As a result, accessory part 1 does not remain at the side of cart 100 during transport any longer, but is positioned above worktop 8, which prevents lateral collisions.

For working on worktop 8 of cart 100, strap element 20 may be swiveled outwards around corner post 10, in accordance with the invention, in order to make the space above worktop 8 accessible.

The handling of medical or organization carts is surprisingly improved thanks to the swivelability of strap element 20.

In a hospital, it is important that medical or organization carts may be strung together, if required. A known medical or organization cart is provided with a rail system for attaching accessories at the side of the cart body, and due to the rail system attached at the side, with the accessory parts mounted at that, it is hardly possible to carry out an immediate stringing-together of the carts.

In contrast to this, with the embodiment depicted in FIG. 1, corner post 10 is inserted into corner profile 4 of cart 100, and strap element 20 which is mounted at corner post 10 may be swiveled horizontally inwards in order to leave the spaces to the sides of the cart free for stringing together cart 100.

In accordance with the invention, strap element 20 may be mounted at any location of corner post 10 in the longitudinal direction of corner post 10, and adapter 30 may be mounted at any location of strap element 20 in the longitudinal direction of strap element 20. In combination with the swivellability of strap element 20 at corner post 10, a clearly more flexible attachment of accessories, compared with the state of the art, is possible.

Corner post 10 is provided with a plurality of grooves 12 at its radial outer side, each of which extends horizontally around corner post 10. Connection element 22 of strap element 20 is provided with a projection which is not depicted in FIG. 1 and which corresponds to groove 12 and forms a positive connection of strap element 20 with corner post 10.

In accordance with the invention, the strength of the mounting of strap element 20 at corner post 10 is considerably increased as a result of this positive connection.

It is particularly advantageous that during the transport of cart 100 this positive connection avoids as far as possible vibrations of strap element 10, which vibrates during transport as a result the leverage at corner post 10 and, if applicable, also as a result of its elastic connection element 22 made out of plastic. Adapter 30 at strap element 20 also contributes to this, which adapter 30 exerts a preload onto strap element 20.

For the formation of a positive click-in connection of strap element 20 with corner post 10, strap element 20, which is, connection element 22 which is made out of plastic and is approximately U shaped or horseshoe-shaped, is attached at any location between two adjacent grooves 12 of corner post 10 in the horizontal direction, and is snapped in there.

The projection of strap element 20 is frequently between two grooves 12 at the outer surface of corner post 10, and not yet exactly clicked into the desired groove 12 at this time. There remains a gap between the outer surface of corner post 10 and the inner surface of U-shaped connection element 22.

If necessary, connection element 22 is then moved slightly up or down until the projection of connection element 22 clicks into the desired groove 12.

As a result, the positive click-in connection has been formed. Since in this embodiment, the outside diameter of corner post 10 is, for instance, approx. 2 mm larger than the inside diameter of connection element 22, a firm click-in connection in combination with a stable clamping connection is possible.

Strap body 24 is a hollow profile made out of a light metal in this embodiment. Thus, a sufficiently strong strap with low weight of strap element 22 may be put into practice, the load capacity of which has been optimized.

Strap body 24 may be linked with connection element 22 easily by means of slipping it on and may be removed from it. Thus, strap elements 20 of different lengths may be employed at cart 100 for different potential uses.

In accordance with the invention, an accommodation space 32 of adapter 30 is provided which may accommodate a further accessory part, in particular by means of clamping, when adapter 30 is mounted at strap element 20.

Figure 2:
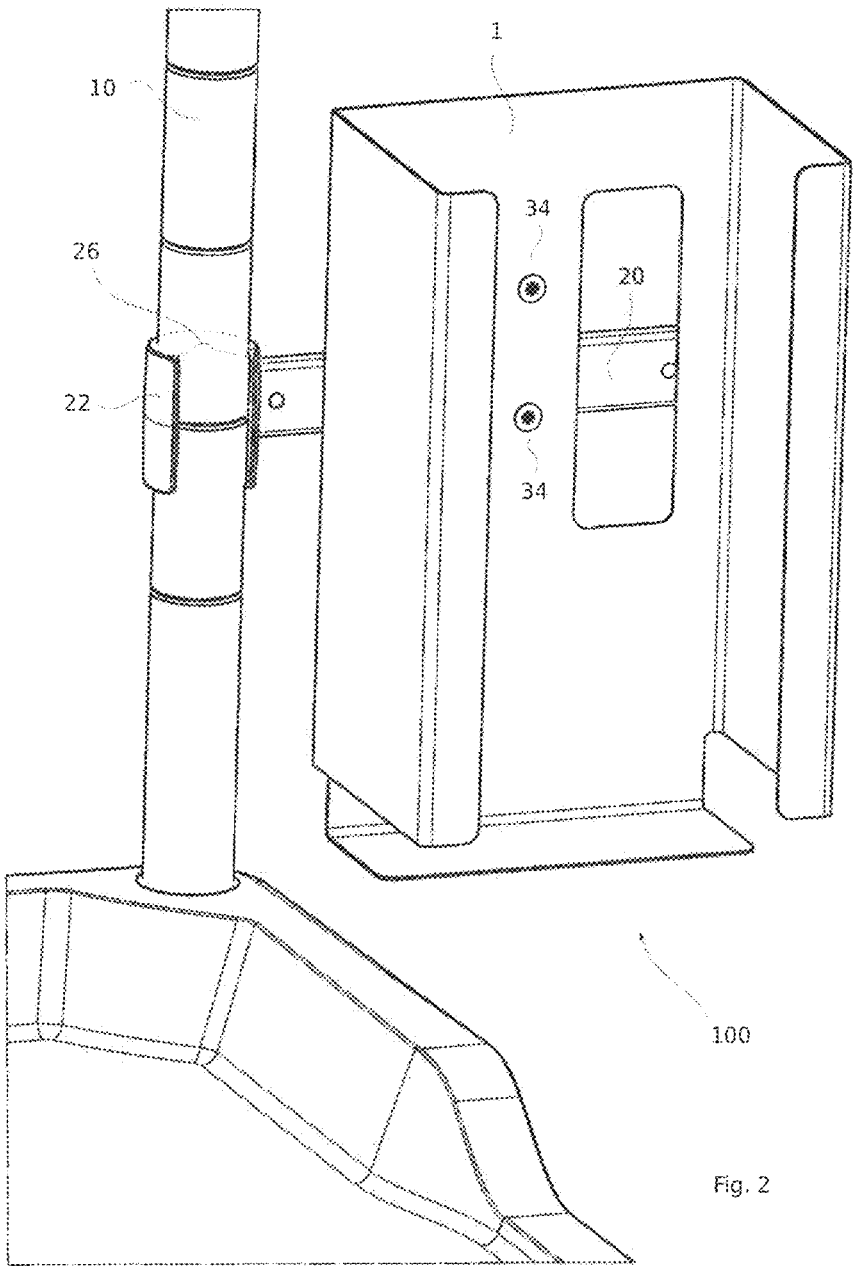
FIG. 2 the embodiment of the medical or organization cart in accordance with the invention according to FIG. 1, observed in the direction V.

In FIG. 2, the connection of accessory part 1 with adapter 30 is visible. Accessory part 1 is attached at adapter 30 with the help of two screws 34.

Connection element 22 of strap element 20 is clamped to corner post 10 and is virtually horseshoe-shaped when looked on from above. The connection element is provided with a wrap-around angle 26 which amounts to approximately 240° according to the embodiment depicted in FIG. 2. With such a wrap-around angle, a sufficiently large clamping surface is put into practice. A detaching force of at least 10 kg is therewith guaranteed.

Connection element 22 is made out of plastic and is approx. 7 cm high in this embodiment.

Figure 3C:
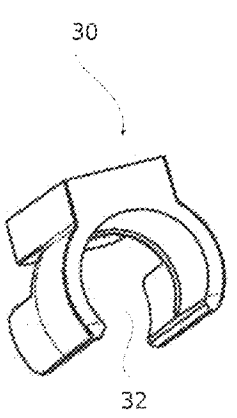
FIG. 3*c* the adapter of the embodiment of the medical or organization cart in accordance with the invention according to FIG. 1 in a further schematically depicted fashion.
Figure 3B:
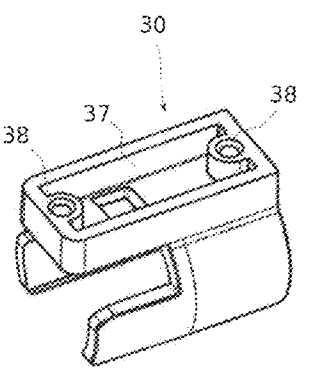
FIG. 3*b* the adapter of the embodiment of the medical or organization cart in accordance with the invention according to FIG. 1 in a further schematically depicted fashion.
Figure 3A:
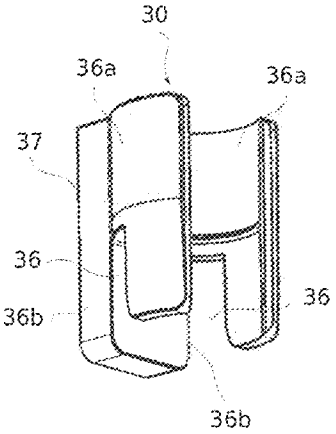
FIG. 3*a* the adapter of the embodiment of the medical or organization cart in accordance with the invention according to FIG. 1 in a schematically depicted fashion.

Details of adapter 30 are visible from FIGS. 3*a*, 3*b* and 3*c*.

Adapter 30 is an injection-molded part made out of plastic and is provided with two U-shaped clamping elements or retaining noses 36*a* which form each a recess 36. With the help of retaining noses 36*a*, adapter 30 may be slipped on strap element 20. The width of U-shaped recesses 36 is 2 mm smaller than the thickness of strap body 24 in this embodiment in order to guarantee a sufficiently large clamping force.

Two lateral legs 36*b* of U-shaped retaining noses 36*a* form a rectangular-shaped back element 37 of adapter 30. At back element 37, two internal threads 38 are provided for the screw connection with accessory part 1.

Figure 4:
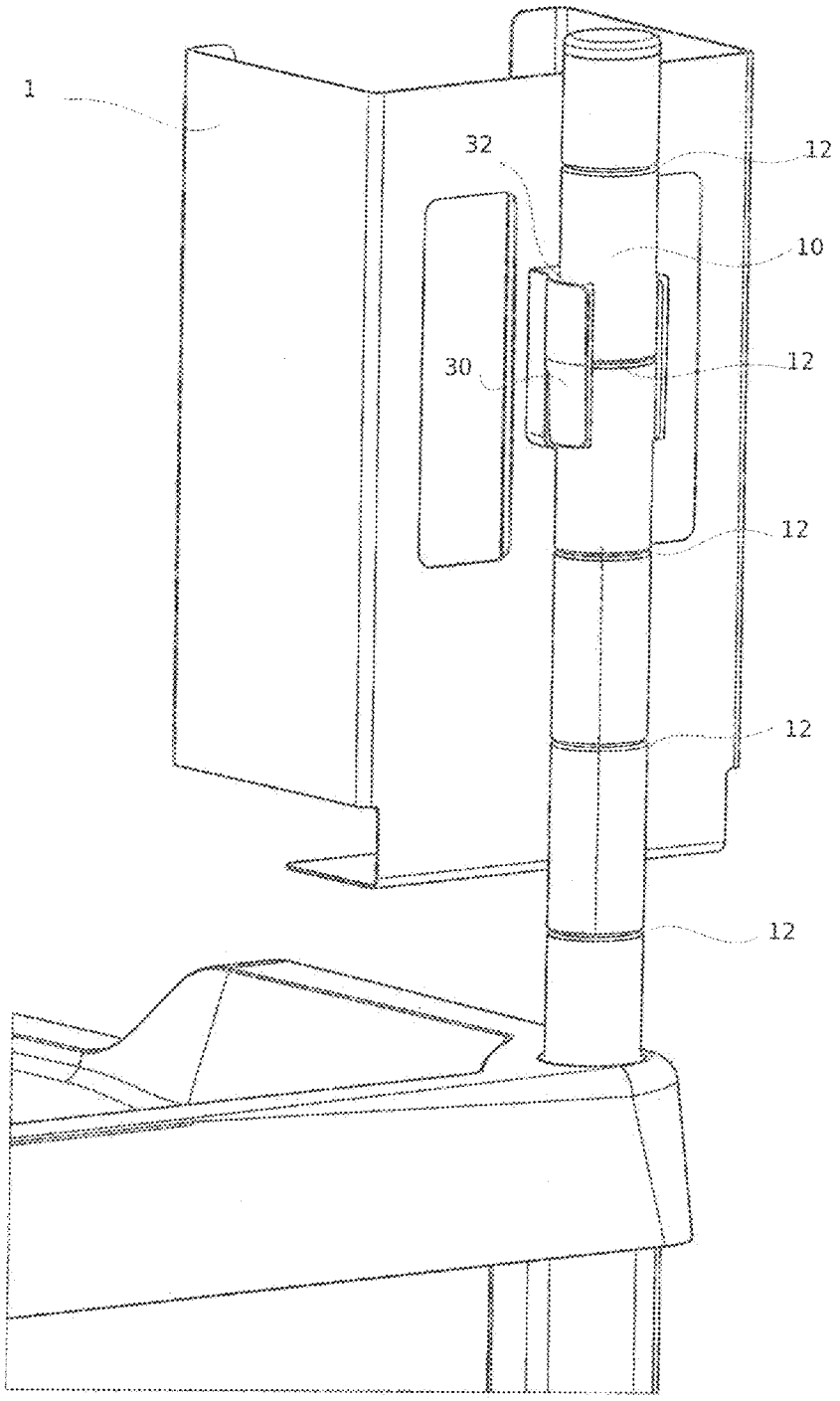
FIG. 4 a further schematically depicted embodiment of the medical or organization cart in accordance with the invention.

In the embodiment of cart 100 depicted in FIG. 4, adapter 30 is mounted directly at corner post 10 by means of clamping. For the purpose of clamping, the inside diameter of the accommodation space 32 of adapter 30 is slightly smaller than the outside diameter of corner post 10.

Adapter 30 is provided with a projection which is not depicted and which, like the projection of connection element 22 of strap element 20 in the embodiment according to FIG. 1, corresponds to the groove 12 of corner post 10 and forms a positive click-in connection of adapter 30 with corner post 10.

If adapter 30 is positively attached to corner post 10, the stability of the mounting of adapter 30 is considerably increased in accordance with the invention.

In accordance with the invention, adapter 30 made out of plastic may be swiveled around corner post 10. It is to be understood that adapter 30 could also be swiveled around a corner post 10 without grooves 12 even if it did not have the projection.

Figure 5:
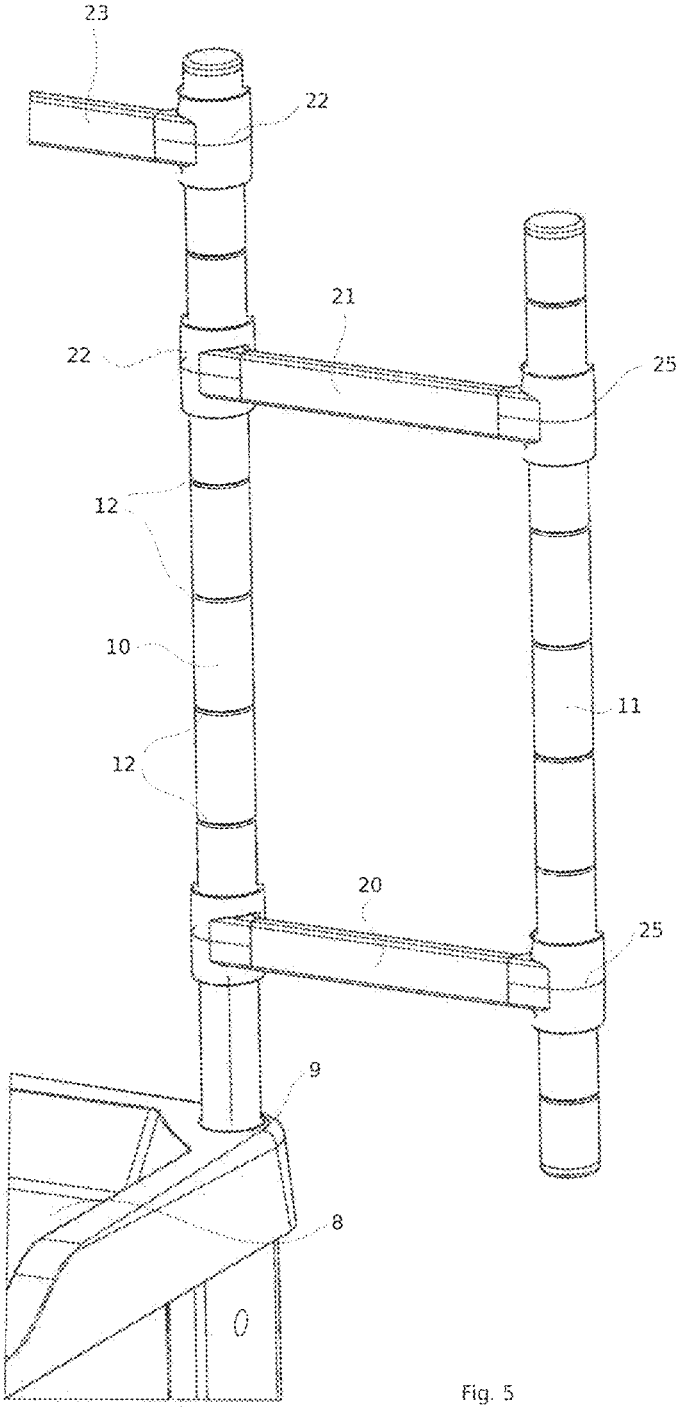
FIG. 5 a further schematically depicted embodiment of the medical or organization cart in accordance with the invention.

In FIG. 5, a further embodiment of the medical or organization cart is provided with a worktop 8 with a corner hole 9. Worktop 8 consists in part of plastic and is fixedly attached on the cart body by means of clamping.

Corner hole 9 runs vertically through worktop 8. Corner post 10 engages with the fastening channel 6 of corner profile 4 via corner hole 9 of worktop 8. The top surface of worktop 8 is larger than the top surface of the cart body which is adjacent to corner profile 4.

In this embodiment, two further strap elements 21 and 23 are mounted at corner post 10. The strap elements or cross straps 20 and 21 are respectively provided each with a further connection element 25 which is linked with the end of cross straps 20 and 21 which is remote from corner post 10, and is connected with a further post 11 which is shorter compared with corner post 10. Further connection elements 25 are the same injection-molded parts as connection elements 22. Further post 11 ends above the cart body or worktop 8, respectively.

As a result, the stability of the mounting of cross straps 20 and 21 with the accessories which are accommodated thereat/thereon, but are not depicted in FIG. 5, is further improved. The ends of cross straps 20 and 21 which are remote from corner post 10 are namely mounted at second post 11 and no longer sway in the air.

Besides, the medical staff may easily grip second post 11 for swiveling the cross strap, which post ends above the cart body or worktop 8, respectively, and then exert a force towards the inside or outside.

Cross straps 21 and 23 are each provided with a projection for positively connecting with the grooves 12 of corner post 10, which are positioned adjacently to and above each other.

In accordance with the invention, the height of connection elements 22 of cross straps 21 and 23 is determined in such a fashion that the two cross straps 21 and 23 may simultaneously form positive connections with the adjacent grooves 12 above one another.

Figure 6:
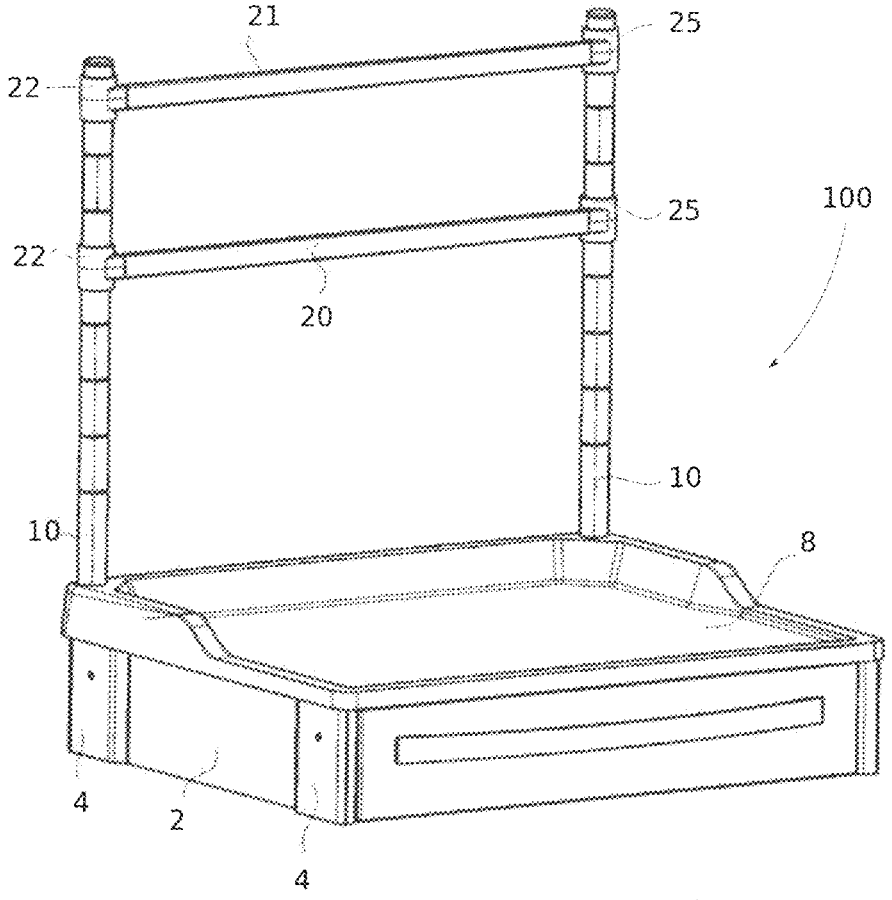
FIG. 6 a further schematically depicted embodiment of the medical or organization cart in accordance with the invention.

In FIG. 6, a further preferred embodiment of cart 100 is depicted which is provided with two corner posts 10. The two corner posts 10 extend vertically in parallel with each other and are fixedly attached to corner profiles 4 of cart 100 via worktop 8. Between the two corner posts 10 and at them, two cross straps 20 and 21 are mounted which are positioned in parallel to each other and above one another and serve for the purpose of attaching accessories at cart 100.

As a result, the strength of the mounting of cross straps 20 and 21 at the cart is further increased since the two ends 22 and 25 of cross straps 20 and 21 are each mounted at one corner post 10 which is fixedly attached to cart 100.

Furthermore, in this embodiment relatively long cross straps 20 and 21 are provided for accommodating large or broad accessories, respectively, and/or a number of accessory parts.

The invention claimed is:

1. A medical or organization cart with a cart body which is formed in particular essentially in the shape of a straight prism, wherein the cart body is provided with at least one corner post which is fixable to the cart body via at least one of a screw, clamping, and/or plug connection, wherein the corner post is provided with at least one guide element which extends peripherally at the corner post, at least one of a strap element and/or one adapter may be mounted at the corner post or detached therefrom, for the purpose of attaching accessories at the medical or organization cart, wherein the strap element and/or the adapter is provided, for the connection with the corner post, with a connection element at an end which is adjacent to the corner post, which may be clamped to the corner post, wherein the connection element is engaged with the guide element and may be swiveled around the corner post, and wherein the connection element at least partially encloses the corner post at an angle larger than 180°, in particular larger than 200°.

2. The medical or organization cart according to claim 1, wherein the corner post is provided with guide elements in discrete locations along its vertical extension to provide a tongue-and-groove combination and/or a magnetic coupling between connection element and corner post, with the help of which the connection element may be attached to the corner post, in particular clipped on or clamped to the latter.

3. The medical or organization cart as claimed in claim 1, wherein the connection element may be slipped onto the corner post in a radial direction, and is detachable from the corner post by means of traction in a radial direction as well.

4. The medical or organization cart as claimed in claim 1, wherein the connection element is configured substantially U-shaped when viewed in the top view, and at least the side legs of the U are configured from an elastically resilient material having a non-destructive movability of at least 10% of the inside diameter of the connection element.

5. The medical or organization cart as claimed in claim 1, wherein the corner post comprises a guide groove as a guide element and the connection element comprises a projection or that the connection element comprises a guide groove and the corner post comprises a projection as a guide element.

6. The medical or organization cart as claimed in claim 1, wherein the inside diameter of the connection element of the strap element and/or of the adapter for the connection with the corner post is smaller, in the state separated from the corner post, than the outside diameter of the corner post, in particular by approx. 2 mm, such that when the strap element and/or the adapter is connected with the corner post by means of clamping, a preload is provided at the inside of the connection element.

7. The medical or organization cart as claimed in claim 1, wherein the corner post is provided with at least one groove at corner post's radial outer side which extends in particular circumferentially, and that the connection element is provided with a projection which fits into the groove at least in part, in particular as an at least dot-shaped projection, in particular corresponds to the cross section of the groove, and which forms a positive connection of the strap element and/or the adapter with the corner post.

8. The medical or organization cart as claimed in claim 1, wherein by means of a horizontal snapping-in of the connection element at the corner post, the strap element and/or the adapter may be snapped close or open at the corner post.

9. The medical or organization cart as claimed in claim 5, wherein by means of a vertical snapping-in of the projection of the connection element into the groove of the corner post, the strap element and/or the adapter may be engaged with the corner post.

10. The medical or organization cart as claimed in claim 1, wherein the corner post is provided with a plurality of grooves at corner post's radial outer side, which are arranged on top of each other, and which in particular extend each horizontally in a circumferential fashion.

11. The medical or organization cart as claimed in claim 1, wherein the strap element is provided with a strap body which extends in the longitudinal direction and which is in particular a hollow profile, and wherein the strap body is linked with the connection element.

12. The medical or organization cart as claimed in claim 1, wherein, using the same adapter, accessories may be mounted to either the corner post or the strap element.

13. The medical or organization cart as claimed in claim 1, wherein the adapter is provided with at least one fastening element at which the accessories may be mounted.

14. The medical or organization cart as claimed in claim 1, wherein at least two corner posts are provided which extend vertically in parallel to each other and may at least be indirectly fixed to the cart body, as well as between which and at which at least one cross strap may be mounted for attaching accessories horizontally at the medical or organization cart.

15. The medical or organization cart as claimed in claim 1, wherein at the same time at least two adapters are mounted at the strap element or the cross strap, respectively, or at the corner post, or at least one adapter is mounted at the strap element or the cross strap, respectively, and at least one further adapter is mounted at the corner post, which adapters commonly accommodate accessories.

16. The medical or organization cart as claimed in claim 3, wherein the connection element may be slipped onto the corner post in a radial direction by means of clamping or clipping.

17. The medical or organization cart as claimed in claim 4, wherein at least the side legs of the U are configured from an elastically resilient material having a non-destructive movability of at least 20% of the inside diameter of the connection element.

18. The medical or organization cart as claimed in claim 11, wherein the strap body comprises a light metal.

19. The medical or organization cart as claimed in claim 14, wherein the at least two corner posts are insertable into the cart body.

20. The medical or organization cart as claimed in claim 10, wherein the plurality of grooves are arranged at a uniform vertical distance from each other.

* * * * *